US007095392B2

(12) United States Patent
Lin

(10) Patent No.: US 7,095,392 B2
(45) Date of Patent: Aug. 22, 2006

(54) INVERTER CONTROLLER WITH AUTOMATIC BRIGHTNESS ADJUSTMENT CIRCUITRY

(75) Inventor: Yung-Lin Lin, Palo Alto, CA (US)

(73) Assignee: 02Micro International Limited, Grand Cayman (KY)

( * ) Notice: Subject to any disclaimer, the term of this patent is extended or adjusted under 35 U.S.C. 154(b) by 18 days.

(21) Appl. No.: 10/360,412

(22) Filed: Feb. 7, 2003

(65) Prior Publication Data

US 2004/0155853 A1 Aug. 12, 2004

(51) Int. Cl.
*G09G 3/36* (2006.01)

(52) U.S. Cl. ..... 345/87; 345/88; 345/102

(58) Field of Classification Search ..... 345/87, 345/88, 204, 211, 102, 207, 690; 315/82, 315/169.3, 291, 219, 224, 307; 356/402; 362/233, 260; 250/205; 455/89, 90; 363/40
See application file for complete search history.

(56) References Cited

U.S. PATENT DOCUMENTS

| | | | | |
|---|---|---|---|---|
| 5,272,327 | A * | 12/1993 | Mitchell et al. | 250/205 |
| 5,487,181 | A * | 1/1996 | Dailey et al. | 455/90.2 |
| 6,114,814 | A * | 9/2000 | Shannon et al. | 315/219 |
| 6,316,881 | B1 * | 11/2001 | Shannon et al. | 315/219 |
| 6,388,388 | B1 * | 5/2002 | Weindorf et al. | 315/169.3 |
| 6,396,217 | B1 * | 5/2002 | Weindorf | 315/169.1 |
| 6,396,722 | B1 | 5/2002 | Lin | 363/98 |
| 6,501,234 | B1 | 12/2002 | Lin et al. | 315/307 |
| 6,633,138 | B1 * | 10/2003 | Shannon et al. | 315/224 |
| 6,703,796 | B1 * | 3/2004 | Che-Chen et al. | 315/291 |
| 6,761,470 | B1 * | 7/2004 | Sid | 362/233 |
| 6,762,741 | B1 * | 7/2004 | Weindorf | 345/102 |
| 2002/0101166 | A1 * | 8/2002 | Weindorf et al. | 315/82 |
| 2003/0025462 | A1 * | 2/2003 | Weindorf | 315/291 |
| 2003/0030386 | A1 * | 2/2003 | Leeb et al. | 315/291 |
| 2003/0090913 | A1 * | 5/2003 | Che-Chen et al. | 363/21.12 |
| 2003/0161164 | A1 * | 8/2003 | Shannon et al. | 363/40 |
| 2003/0214655 | A1 * | 11/2003 | Weiss et al. | 356/402 |
| 2005/0156536 | A1 * | 7/2005 | Ball | 315/291 |
| 2005/0162098 | A1 * | 7/2005 | Ball | 315/291 |

FOREIGN PATENT DOCUMENTS

TW 419173 1/2001

OTHER PUBLICATIONS

English translation of Preliminary Notice of Rejection from related Taiwan application, dated Feb. 6, 2006.

* cited by examiner

*Primary Examiner*—Bipin Shalwala
*Assistant Examiner*—Prabodh Dharia
(74) *Attorney, Agent, or Firm*—Grossman, Tucker, Perreault & Pfleger, PLLC

(57) ABSTRACT

An inverter controller for an LCD panel display with automatic brightness adjustment circuitry is provided. In one exemplary embodiment, the controller includes a look-up table that receives a signal indicative of the ambient light around the LCD panel and generates a signal corresponding to desired panel brightness. The signal corresponding to the desired panel brightness is, in turn, used as a threshold signal in a conventional feedback inverter topology supplying power to lamps associated with the LCD panel. In another exemplary embodiment, a master controller is provided that includes a light sensor controller to poll a slave light sensor to generate a signal indicative of the ambient light around the LCD panel.

5 Claims, 4 Drawing Sheets

INVERTER CONTROLLER WITH AUTOMATIC BRIGHTNESS ADJUSTMENT CIRCUITRY

FIELD OF THE INVENTION

The present invention relates to an inverter controller, and more particularly, to an inverter controller that includes automatic brightness adjustment circuitry. General utility for the present invention is for LCD panel displays such as may be associated with portable computers and portable electronic devices, and/or stand-alone LCD panel monitors and/or television displays.

BACKGROUND OF THE INVENTION

FIG. 1 depicts a conventional computer system 10 having a conventional LCD panel display 52. An inverter controller 150 is provided to drive one or more cold cathode fluorescent lamps (CCFLs) 38*a* and/or 38*b*, and includes a transformer 152 and and inverter controller 154, as is well understood in the art. A light sensor 156 is provided to generate a signal of the ambient light around the panel 52. The computer system also includes a conventional system CPU 158. In the conventional system, the optical sensor and inverter controller are controlled by the system CPU, via signal and data lines 101, 102 and 103, 104, respectively. Typically, these signal lines represent data and/or clock signals, and are operable to control the respective devices. The light sensor is used to effectively set the panel brightness based on the ambient light around the panel. However, such a topology as disclosed in FIG. 1 requires system CPU bandwidth and separate wire traces from the system CPU to the controller 150. Thus, there exists a need to eliminate both system CPU requirements and additional wiring traces while still maintaining panel brightness control.

SUMMARY OF THE INVENTION

Accordingly, in one exemplary embodiment, the present invention provides a brightness controller for an LCD panel display, comprising an optical sensor generating a signal indicative of ambient light around the LCD panel; a look-up table receiving the signal indicative of ambient light around the LCD panel and adapted to generate a selected one of a plurality of target panel brightness level signals based on the signal indicative of ambient light around the LCD panel; and an inverter circuit adapted to receive one of the plurality of target panel brightness level signals to control power delivered to the LCD panel.

The present invention also provides an LCD panel, comprising a plurality of lamps; and a brightness controller controlling the brightness of said lamps, said brightness controller comprising an optical sensor generating a signal indicative of ambient light around said LCD panel; a look-up table receiving said signal indicative of ambient light around said LCD panel and adapted to generate a selected one of a plurality of target panel brightness level signals based on said signal indicative of ambient light around said LCD panel; and an inverter circuit adapted to receive one of said plurality of target panel brightness level signals to control power delivered to said lamps.

The present invention also provides a computer system that includes the LCD panel, lamps and brightness controller.

In another exemplary embodiment, the present invention provides a master/slave brightness controller for an LCD panel display, comprising: an optical sensor generating a signal indicative of ambient light around said LCD panel; a micro controller controlling said optical sensor to generate said signal indicative of ambient light around said LCD panel; a look-up table receiving said signal indicative of ambient light around said LCD panel and adapted to generate a selected one of a plurality of target panel brightness level signals based on said signal indicative of ambient light around said LCD panel; and an inverter circuit adapted to receive one of said plurality of target panel brightness level signals to control power delivered to said LCD panel.

It will be appreciated by those skilled in the art that although the following Detailed Description will proceed with reference being made to preferred embodiments and methods of use, the present invention is not intended to be limited to these preferred embodiments and methods of use. Rather, the present invention is of broad scope and is intended to be limited as only set forth in the accompanying claims.

Other features and advantages of the present invention will become apparent as the following Detailed Description proceeds, and upon reference to the Drawings, wherein like numerals depict like parts, and wherein:

DETAILED DESCRIPTION OF EXEMPLARY EMBODIMENTS

Figure 1:
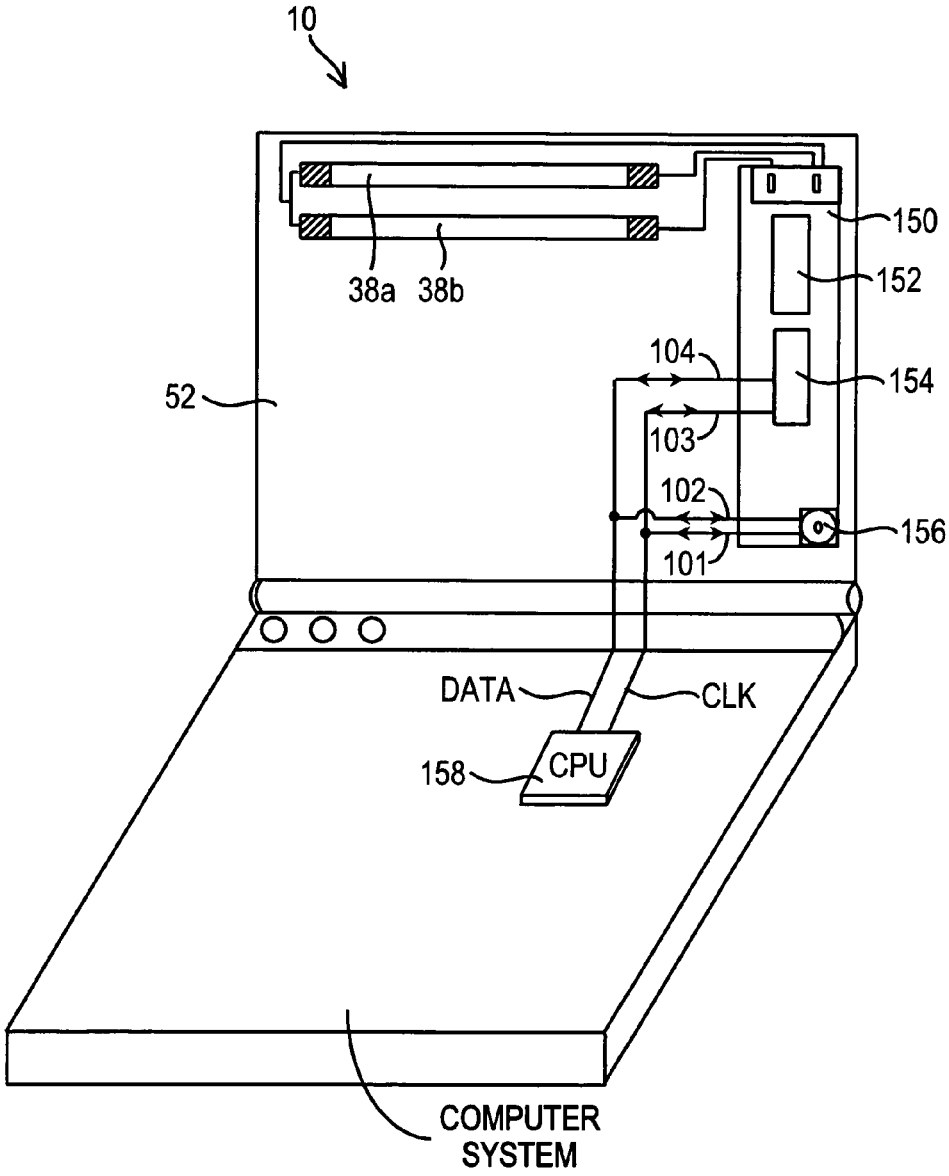
FIG. 1 PRIOR ART
FIG. 1 depicts a system level block diagram of an inverter controller system associated with a portable computer.
Figure 2:
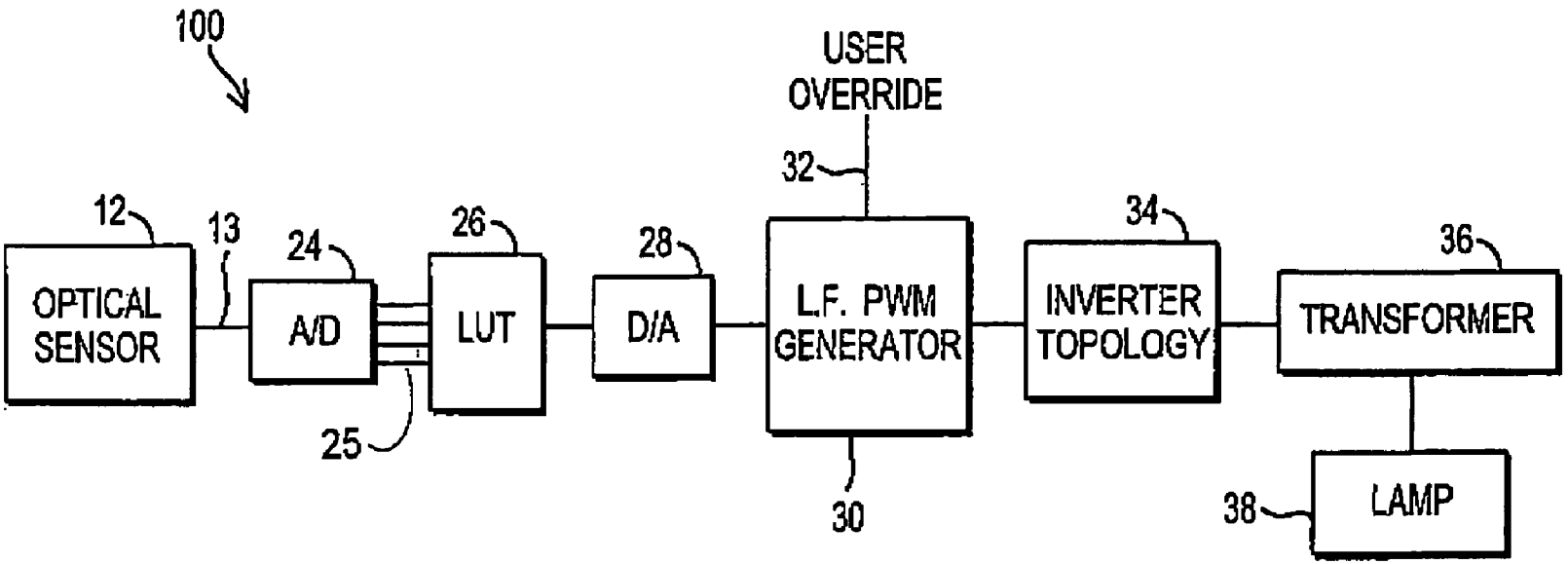
FIG. 2 depicts a block diagram of an exemplary inverter controller of the present invention that includes automatic brightness adjustment circuitry.

FIG. 2 depicts a block diagram of an exemplary inverter controller system 100 of the present invention that includes automatic brightness adjustment circuitry. As a general matter, the controller 100 of the present invention includes on-board circuitry to adjust the brightness of the LCD panel, without requiring signal lines to the system CPU. One exemplary embodiment of the controller 100 includes an optical sensor 12, and a look up table (LUT) 26 to generate a signal indicative of a programmed brightness level. Advantageously, the present invention includes circuitry that can control the brightness of the panel without requiring communication to the CPU of the computer system, as is done with conventional brightness adjustment modules.

As described above, the optical sensor 12 monitors the ambient light of the operating environment of the LCD panel, and outputs a signal 13 indicative of (or proportional to) the amount of ambient light present. In the exemplary embodiment, an analog to digital converter (A/D) 24 is provided that generates a plurality of binary signals 25 based on the input signal 13. In the drawing, four binary signals are depicted which would generate 16 levels of brightness, but those skilled in the art will recognize that the bit depth of the A/D may be increased or decreased to generate a desired resolution. A look-up table (LUT) 26 receives the binary representation of the ambient light and generates a target or desired brightness for the panel. The formulation of the LUT may include, for example, a plurality of column representing the binary input values and a corresponding column representing the desired or target panel brightness. The value for the target panel brightness may be based on a linear division (i.e., even division given the bit depth of the A/D converter), a weighted division, logarithmic division, etc. The exemplary embodiment depicts the LUT with four digital inputs and one digital output, however, the LUT may be adapted to accommodate any number of inputs and/or outputs depending on the application. Such a construction will be readily understood by those skilled in the art. Of course, the implementation of the LUT may be accomplished in a variety of ways, and the above description represents only one exemplary embodiment.

The output signal from the LUT 26 is a desired or target panel brightness signal. Optionally, a D/A converter 28 can be provided to convert the output of the LUT 26 to an analog signal, although if the inverter topology is adapted to receive digital preset signal the D/A may be omitted. In any event, the target panel brightness signal is used as a control signal for the inverter, such as a threshold value in a closed loop feedback system that regulates power (brightness) to the lamps in the panel. In one exemplary embodiment of FIG. 2, power adjustment (e.g., dimming) is accomplished using conventional burst mode dimming techniques well understood in the art.

In this example, the target brightness signal is input into the low frequency PWM signal generator 30 that is adapted to generate a burst mode signal for adjusting power to the lamps of the panel. Supplying power to multiple lamps using burst mode techniqaes is disclosed in U.S. Pat. No. 6,501,234 assigned to the same assignee, and hereby incorporated by reference in its entirety. In essence, the target brightness signal sets the pulse width of the burst mode signal generated by the low frequency PWM generator 30. The low frequency PWM generator 30 may also include a user override switch 32 that sets the brightness to a user-defined level regardless of the value of the target brightness signal.

In turn, the burst mode signal generated by the generator 30 is utilized by the inverter topology 34 to generate an AC signal from a DC signal. A transformer 36 steps up the AC signal to a sufficient voltage to both ignite the lamp 38, and operate the lamp 38 in steady state. The inverter topology may include a full bridge (4 switches), half bridge (2 switches), royer, push pull, class D, other type of inverter topology well known in the art.

Figure 3:
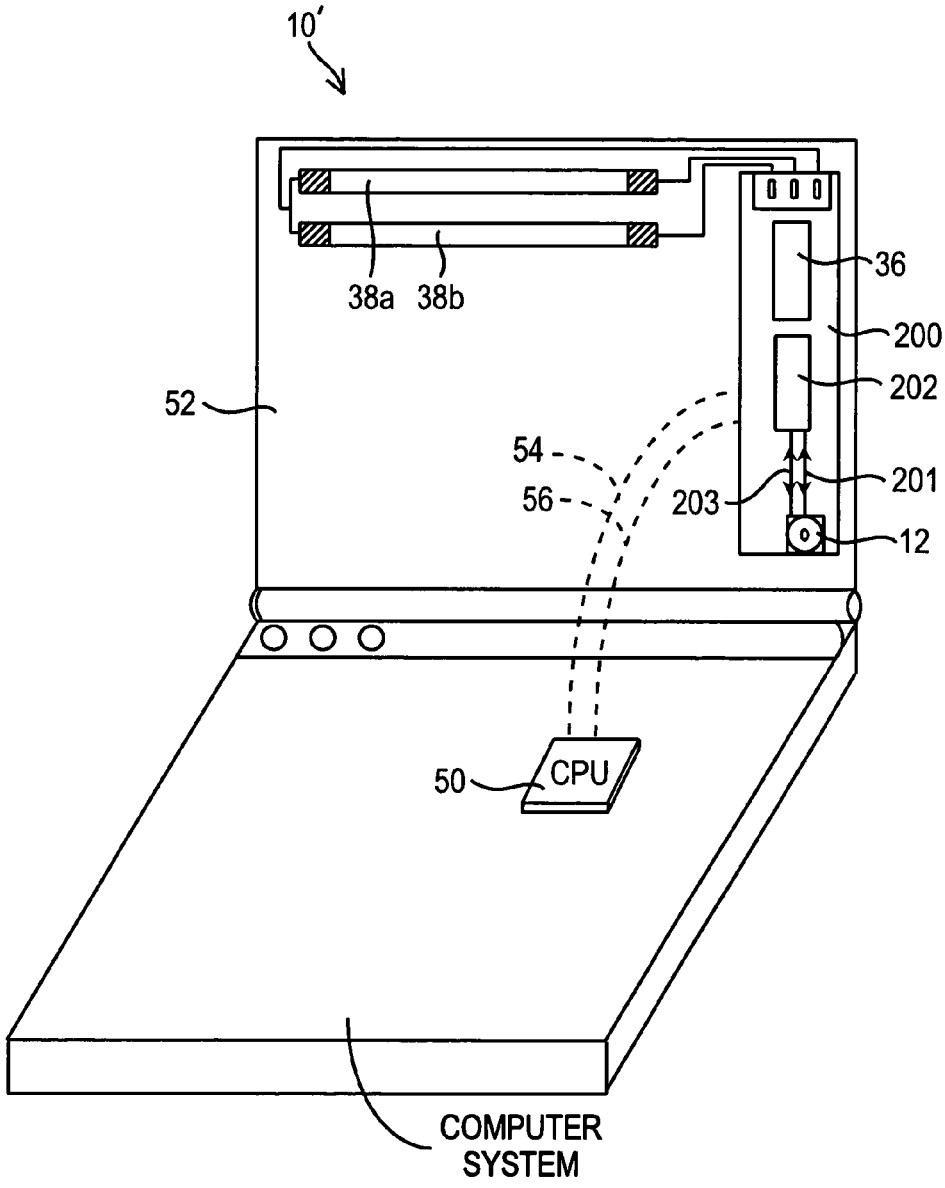
FIG. 3 depicts a system level block diagram of an exemplary master mode inverter controller of the present invention.

In the embodiment of FIG. 2, the inverter essentially responds to the signals generated by the optical sensor, and eliminates the need for wiring between the controller 100 and the system CPU. In the embodiment of FIG. 3, a master mode controller topology is provided that, unlike the embodiment of FIG. 2, includes an inverter controller that behaves a master controller for the optical sensor.

Referring now to FIG. 3, a portable computer system 10' is adapted with a master mode auto brightness controller 200 according to another exemplary embodiment of the present invention. The controller 200 includes an inverter controller 202, an optical sensor 12 and a transformer 36, operable to control one or more CCFL lamps 38*a* and/or 38*b*. The controller 202 of this embodiment includes circuitry to directly poll the optical sensor 12 to request information related to ambient lighting conditions. Thus, the controller 202 is the master and the optical sensor 12 is the slave device. This embodiment also eliminates the need for communications wiring traces (e.g., communication channels 54 and 56) between the controller 200 and the system CPU 50. Thus, the controller 202 is the master and the optical sensor 12 is a slave that is controlled by the controller 202.

Figure 4:
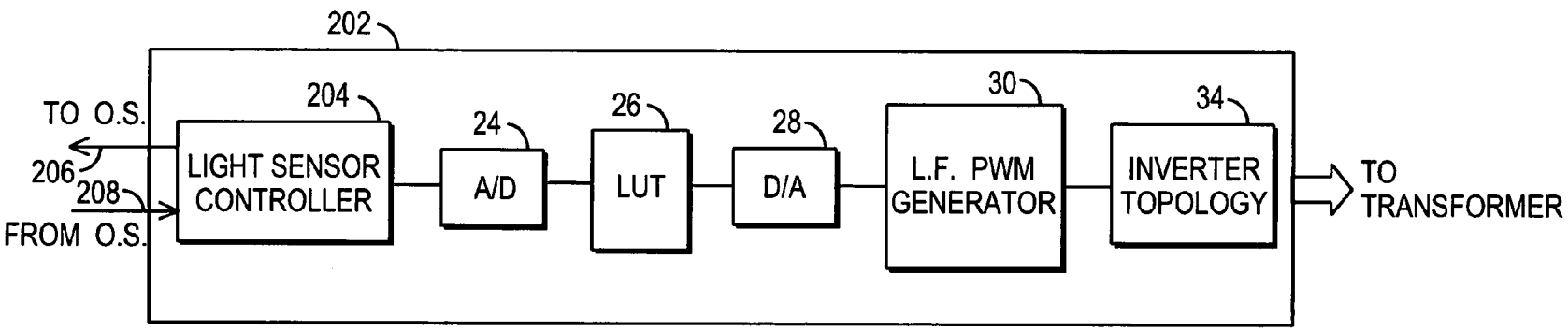
FIG. 4 depicts a block diagram of an exemplary master/slave inverter controller of the present invention that includes automatic brightness adjustment circuitry.

FIG. 4 depicts an exemplary controller 202 according to the master-slave embodiment of FIG. 3. The controller 202 is similar to the controller 100 of FIG. 2, except that a light sensor micro-controller 204 is provided. The micro controller is adapted to generate a control signal 206 to the optical sensor to, for example, power the optical sensor to sense the ambient light around the LCD panel (i.e., poll the optical sensor). The ambient light signal 208 is in turn processed by the micro-controller 204 and is utilized by the LUT 26 and inverter 34 in a manner described above. The micro-controller 204 can include circuitry to poll the optical sensor at predefined or user-defined intervals.

Thus, there has been provided a master mode auto brightness controller for an LCD panel. Those skilled in the art will recognize numerous modifications to the present invention. For example, burst mode dimming techniques described with reference to FIGS. 2 and 4 may instead be replaced with phase shifting techniques, such as disclosed in U.S. Pat. No. 6,396,722, assigned to the same assignee, and hereby incorporated by reference in its entirety, and/or other dimming techniques known in the art. In such an embodiment, the target brightness signal generated by the LUT would be used as a reference signal to properly phase the switches of the inverter to generate the desired brightness level. Also, it should be readily recognized that in multiple lamp environments, the LUT can be adapted to generate multiple target brightness signals, one for each inverter associated with each lamp. The LUT can be constructed, for example, using a register or EEPROM device that includes a table of inputs and outputs. Of course, a processor could be used in place of the LUT, however, such an implementation may increase the overall cost of the device.

These and other modifications will become apparent to those skilled in the art, and all such modifications are deemed within the spirit and scope of the present invention, only as limited by the appended claims.

The invention claimed is:

1. A master/slave brightness controller for an LCD panel display, comprising:

an optical sensor generating a signal indicative of ambient light around said LCD panel;

a micro controller controlling said optical sensor to generate said signal indicative of ambient light around said LCD panel, said micro controller is also adapted to generate said signal indicative of ambient light around said LCD panel independently of a host system CPU;

a look-up table receiving said signal indicative of ambient light around said LCD panel and adapted to generate a target panel brightness level signal based on said signal indicative of ambient light around said LCD panel;

a low frequency PWM circuit capable of generating a burst mode signal having a pulse width based on said target panel brightness signal; and an inverter circuit adapted to control power delivered to said LCD panel based on, at least in pan, said burst mode signal; said inverter circuit is also adapted to control power delivered to said LCD panel independently of a host system CPU.

2. A master/slave brightness controller for an LCD panel display as claimed in claim 1, further comprising an A/D converter circuit receiving said signal indicative of ambient light around said LCD panel and generating a digital signal having a desired bit dept.

3. A master/slave brightness controller for an LCD panel display as claimed in claim 1, wherein said inverter circuit selected from the group consisting of full bridge, half bridge, push pull, royer and class D inverter circuits.

4. A master/slave brightness controller for ar LCD panel display as claimed in claim 1, said LCD panel comprising a plurality of lamps receiving power from at least one said inverter circuit.

5. A master/slave brightness controller for an LCD panel display as claimed in claim 1, wherein said look-up table comprising a register of input values and corresponding output values, said input values represented by said signal indicative of ambient light around said LCD panel and said output values represented by said plurality of target panel brightness level signals.

* * * * *